United States Patent [19]

Wallace et al.

[11] Patent Number: 4,715,074

[45] Date of Patent: Dec. 29, 1987

[54] CRIB

[76] Inventors: David R. Wallace, 112 Indiana Drive, Sault Ste. Marie, Ontario, Canada, P6A 4Y5; George E. Rothschild, 1210 Prince of Wales Drive, Ottawa, Ontario, Canada, K2C 1M9; Robert W. Hamilton, 1133 Bayview Drive, Tsawwassen, British Columbia, Canada, V4M 2R8

[21] Appl. No.: 882,787

[22] Filed: Jul. 7, 1986

[30] Foreign Application Priority Data

May 30, 1986 [CA] Canada ..... 510476

[51] Int. Cl.[4] ..... A47D 7/00

[52] U.S. Cl. ..... 5/93 R; 5/99 R; 5/99 B; 5/100; 5/400

[58] Field of Search ..... 5/11, 93 R, 99 R, 99 B, 5/100, 400, 186 R, 186 B

[56] References Cited

U.S. PATENT DOCUMENTS

| | | | |
|---|---|---|---|
| 730,514 | 6/1903 | Churchill . | |
| 1,862,383 | 6/1932 | Mayette | 5/99 B |
| 2,243,691 | 5/1941 | Bakalar . | |
| 2,412,005 | 12/1946 | Parsons . | |
| 2,414,076 | 1/1947 | Webb . | |
| 2,477,231 | 7/1949 | Bourdon . | |
| 2,536,357 | 1/1951 | David . | |
| 2,651,057 | 9/1953 | Power . | |
| 2,823,737 | 2/1958 | Eriksen | 5/93 R |
| 2,866,983 | 1/1959 | Rose | 5/99 R |
| 2,968,817 | 1/1961 | Jacobs et al. . | |
| 3,032,154 | 5/1962 | McNabb, Jr. . | |
| 3,129,439 | 4/1964 | Michal . | |
| 3,354,475 | 11/1967 | Martin . | |
| 3,383,718 | 5/1968 | Spencer . | |
| 3,590,403 | 7/1971 | Mixon | 5/100 |
| 3,634,894 | 1/1972 | Harbison . | |
| 3,680,155 | 8/1972 | McMann . | |
| 3,900,907 | 8/1975 | Mulder . | |
| 3,930,699 | 1/1976 | Schnizlein, Jr. | 5/93 R |
| 3,979,783 | 9/1976 | Spencer . | |
| 4,285,079 | 8/1981 | Hillman . | |

FOREIGN PATENT DOCUMENTS

| | | | |
|---|---|---|---|
| 131362 | 12/1910 | Canada . | |
| 156789 | 6/1914 | Canada . | |
| 201765 | 7/1920 | Canada . | |
| 286230 | 1/1929 | Canada . | |
| 443913 | 9/1947 | Canada . | |
| 524393 | 5/1956 | Canada . | |
| 796904 | 10/1968 | Canada . | |
| 814105 | 6/1969 | Canada . | |
| 1030704 | 5/1978 | Canada . | |
| 1182254 | 2/1985 | Canada . | |
| 2112605 | 6/1972 | France | 5/93 R |
| 791593 | 3/1958 | United Kingdom | 5/99 B |

*Primary Examiner*—Alexander Grosz
*Assistant Examiner*—Michael F. Trettel
*Attorney, Agent, or Firm*—Steele, Gould & Fried

[57] ABSTRACT

A novel, safer crib structure is provided herein. This invention provides a crib in which the mattress can be selectively supported at two different heights with respect to the sides of the crib. In one embodiment, the mattress support is a sheet of plywood securely held in a groove in each of the facing end gables. A fixed height back wall is hinged to the end gables. The front wall is a drop side wall vertically slidably secured to the end gables. To change the height of the mattress, the drop side front wall is slidably removed, the sheet of plywood is slid out of one groove and slid into another groove, and the dropside front wall is again slidably secured to the end gables. In a preferred embodiment, a single groove is used to retain the mattress support, but the end gables are affixed to the back wall in such way that one gable is higher than the other gable. Wheels or castors are provided under the shorter gable to provide a level orientation. The single groove is preferably disposed at a location in the end gables corresponding to one-third of the height of the back wall. When it is desired to change the height of the mattress it is necessary only to invert the crib, to remove the wheels or castors from the top of one end gable and to insert them at the bottom of the other end gable.

24 Claims, 13 Drawing Figures

CRIB

BACKGROUND OF THE INVENTION (i) Field of the Invention

This invention relates to a child's crib of safer construction.

(ii) Description of the Prior Art

There are many forms and designs of child's cribs. For example Canadian Pat. No. 31,362, patented Feb. 28, 1911 by E. Henrikson, provided a folding crib which could be folded up when not in use, or for shipping purposes.

Canadian Pat. No. 156,789, patented July 7, 1914 by J. E. Williams provided an improvement in cots having an ordinary indoor appearance which could be readily converted into one adapted for outdoor use. The structure provided consisted of corner posts, and side and end members permanently connected and spacing the corner posts. The side and end members had longitudinally disposed grooves in their upper faces. The corner posts had vertically disposed grooves. Interchangeable side and end frames were included having their ends provided with extending tongues. The frames were designed so that when inserted between the posts, they had their lower edges received within the grooves of the side and end members and their tongues received within the grooves presented by the posts.

Canadian Pat. No. 201,765 patented July 13, 1920 by P. H. Colt provided a folding wheeled coop which could be readily converted to a crib. That folding crib had side pieces connected together by sectional end pieces, a double crank pivotally carried by one of the side pieces, and a bottom frame pivotally mounted upon the crank. The bottom frame was mounted on the double crank which could be swung into downward or raised positions so as to convert the device into a coop or a crib.

Canadian Pat. No. 286,230 patented Jan. 8, 1929 by C. A. Neilson provided a crib which could be easily and quickly extended in length to accommodate a growing child while maintaining a pleasing and neat appearance. That crib consisted of the combination, with the head, foot and sides of the crib, of pairs of side extensions pivotally connected to the head and foot of the crib. These sides were adapted to take a folded position when not in use so that they were parallel to the head and foot. When extended, they took a position at right angles thereto. Means were provided for releasably fastening the extended extensions to the ends of the crib sides.

Canadian Pat. No. 443,913, patented Sept. 2, 1947 by G. M. Parsons provided a crib which could be converted to a bed. That convertible crib and bed included a base member having an upper mattress-supporting portion, a mattress-confining wall rising above the plane thereof at the front of the base member, a crib-defining superstructure adapted to be supported on the base, and means detachably securing the superstructure to the base. Inset walls were incorporated in the superstructure at the back and at least one end for reducing the mattress-supporting portion to crib-mattress size when the superstructure was in place. Article supporting shelves were supporting at the upper ends of the walls and cooperated with the walls for concealing that portion of the base portion beyond the crib-mattress area when the superstructure was in place.

Canadian Pat. No. 524,393 patented May 1, 1956 by M. Feldstein provided a crib which could be shipped in parts and which could be quickly and easily assembled without the necessity of any tools. That crib had two end frames with side frames extending therebetween, at least one side frame being a vertically movable gate, vertical tracks mounted on the inner surfaces of the end frames near the side frames, means on each end of the gate slidably mounted on an adjacent track, and means for selectively retaining the gate in an upper position. A horizontal bed spring was provided within the frames. Hangers at the ends of the spring were removably securable to the tracks at a plurality of levels on the tracks.

Canadian Pat. No. 796,904 patented Oct. 22, 1968 by A. D. Spencer provided a convertible bedstead serving either as a crib for an infant or as a youth bed for a child. That convertible crib and youth bed included a pair of spaced end panels, a pair of slide rods on the inboard side of each of the end panels, and drop sides slidable upon the slide rods and extendable between the end panels. One of the end panels was of two-part construction with each of its respective slide rods also being of two part construction.

Canadian Pat. No. 814,105 patented June 3, 1969 by H. Heller provided a crib having at least one crib side and extension means associated with that side to raise the effective level thereof to a point at which a child could not climb thereover. The extension means included elongated horizontal elements having a plurality of vertical, parallel, coplanar, spaced-apart rods extending downward therefrom, each rod fitting telescopically downward into its corresponding vertical bar.

Canadian Pat. No. 1,030,704 patented May 9, 1975 by M. Feldstein provided a dropwise crib with means to secure the sides firmly in position without screws. The securing apparatus includes an elongated base element to form part of, or to be secured in a vertical position on, a crib end near a side thereof. A connector element was secured to a movable crib side, was slidably connected to the base element, and was formed with a narrow slot extending downwardly from a relatively large opening. A bore in the connector element was substantially normal to the base element and was positioned to be aligned with the keyhole. A latch pin extended through the bore and had a head on an upper end thereof which was adapted to pass through the opening, the pin fitting in the slot when the connector element was moved downwardly after the head had been moved through the keyhole opening. Means biased the pin in the direction of the base element.

Canadian Pat. No. 1,182,254 patented Feb. 12, 1985 by C. M. Dale provided a crib which avoided the use of a rigid bar forming part of the side frames thereof. That crib included a pair of end wall sections each having a pair of legs for supporting the sections in an upstanding manner and a pair of side wall sections forming an enclosure with the end walls, at least one side wall section being movably mounted between the end wall sections. A canopy was mounted on the end wall sections in spaced relation to the side wall sections, the canapy having at least one pivotally mounted section movable from a closed position over the enclosure to an open position to provide access to the enclosure.

U.S. Pat. No. 73,054 patented June 9, 1903 by T. H. Churchil provided an infant's crib, including of a bottom frame, end frames, means connecting the bottom frame and end frames, side frames and means connecting the bottom and side frames. By such connecting means, the side frames were permitted to be turned down onto and into the plane of the bottom or at right angles thereto, either above or below the bottom.

U.S. Pat. No. 2,243,691 patented May 27, 1941 provides a combination crib and playpen which included a bedstead having side and end rails, and a spring and mattress therein, and grooves in each side rail above and below the mattress and spring end communicating at one thereof. A roll-type play pen floor comprising articulated members forming the surface for the support of the child was mounted in the grooves and was adapted to be movable.

U.S. Pat. No. 2,414,076 patented Jan. 7, 1947 by C. E. Webb provided a bottom support for cribs having means for detachably locking a mattress frame structure at one corner to the supporting structure of a crib. Such lock included a catch member on a first structure and a connecting member on a second structure engageable with the catch member to lock the second structure against movement relative to the first structure in all directions but one. A brace member was provided on the second structure engageable with the catch member to lock the second structure against movement relative to the first structure in all directions but a predetermined one substantially at right angles to the first direction. The brace member was movable in the predetermined direction from a normal position and was engageable with the catch member upon being displaced in that predetermined direction from normal position.

U.S. Pat. No. 2,477,231 patented July 26, 1949 provided a convertible play pen and crib including head and foot boards, a side panel rigidly associating the head and foot boards, a bottom comprising two flat panels hingedly connected by adjacent edges, and a spring and mattress structure mounted on the upper face of the upper of the bottom panels. A second side panel including a plurality of sections was hingedly associated at the adjacent vertical edges of such plurality of sections. Means were provided which hingedly associated the end sections of the second panel with the head and foot boards respectively.

U.S. Pat. No. 2,536,357 patented Jan. 2, 1951 by A. T. David provided an infant's crib having a removable floor and having a side defined by a row of spaced vertical bar elements. Top and bottom horizontal members were provided at opposed ends of the bar elements and were adapted to maintain the bar elements in position. An intermediate horizontal member was fixed relative to the vertical bar elements and was positioned between the top and bottom members. A fabric support sling was mounted on the crib by means of a plurality of loops on the sling, and by means of a continuous keeper rod which extended through the loops and was supported by the intermediate horizontal member.

U.S. Pat. No. 2,651,057 patented Sept. 18, 1953 by W. T. Power provided a combination crib and a playpen including head and foot boards, guide rails secured across the head and foot boards, side bars secured to the head and foot boards to retain them erect in spaced relation to form a crib frame, and side frames movable into and out of operative registry with the head and foot boards to complete the crib frame. Channels were secured to the head and foot boards so that the side frames were slidably mounted to register with the head and foot boards. The base frame included side bars and end bars suitably fastened together, and two end frames. Each end frame including a lower bar, which was hingedly connected to the head and foot ends of the base frame, the end frames being swingable towards and away from each other about the hinged connections to convert the crib to and from a playpen.

U.S. Pat. No. 2,968,817 patented Jan. 24, 1961 by S. B. Jacobs provided an adjustable baby crib which included a main frame having upright sides and ends, the main frame having a vertical slot in one of its sides intermediate the ends. An auxiliary frame adapted to support bedding spanned the interior of the main frame and extended at a right angle to the sides and the ends of the main frame. Linkage means were connected to the ends of the auxiliary frame in such a way that the auxiliary frame was capable of being moved from a low level position to any of a series of higher level positions, in all of the positions the auxiliary frame being within the main frame. Treadle means located beneath the auxiliary frame were operable to cause the auxiliary frame to be moved upwardly or downwardly. Handle means were provided which were capable of engaging portions of the main frame so as to secure the auxiliary frame in any of those positions.

U.S. Pat. No. 3,032,154 patented May 1, 1962 by W. J. McNabb provided a mattress frame suspension and control mechanism for baby cribs including a main frame having upright side and ends, and an auxiliary frame adapted to support bedding spanning the interior of the main frame and extending at a right angle to the sides and the ends of the main frame. A pair of scissors links were pivotally connected to the main frame and auxiliary frame. The auxiliary frame was supported by the scissors links on the main frame and was vertically movable relative thereto to a plurality of positions. Treadle means were provided with counterbalanced means, and with arm means to enable movement of the auxiliary frame between a plurality of positions. The auxiliary frame was securable in any of those plurality of positions.

U.S. Pat. No. 3,129,439 patented Apr. 21, 1964 by J. Michal provided a baby crib having corner posts with an apertured plate therein and a mattress supporting frame, and means for detachably supporting the frame on the posts. Such support means was a particularly specified link secured adjacent to each corner of the frame and cooperating with the plate.

U.S. Pat. No. 3,354,475 patented Nov. 28, 1967 by C. T. Martin provided a quickly releasable connection or joint for the side and end sections of articles employing opposed keyhole slots and coacting headed fasteners carried by arms which were tensioned toward locking positions.

U.S. Pat. No. 3,364,894 patented Jan. 18, 1977 provided a child's crib having floor-supported ends interconnected by sides, at least one of which being vertically adjustable. The sides and at least the major parts of the ends were unitary plastic moldings, and were formed with integral tongue and groove portions through which the ends were operatively connected to the sides. A one-piece mattress support was vertically adjustable on the crib-ends. Such support was a one-piece plastic molding providing a rigid border frame, a grid-like center portion, and spaced elastic connections between the center portion and the ends and sides of the border frames.

U.S. Pat. No. 3,680,155 patented Aug. 1, 1972 by J. R. McMann provided a foldable body crib including a mattress supporting frame with foldable legs, and foldable head and foot boards at either end of the frame. Slatted crib sides were provided with tongue members which were slidably received in slotted brackets arranged for allowing vertical disposition of the sides in hooked relation to the head and foot boards, and alternatively facilitating folding over of the crib sides in juxtaposition with each other on top of the crib mattress. The head and foot boards folded from either end over the sides to complete a flat package. Each crib side was also removable in a vertically-downward direction.

U.S. Pat. No. 3,900,907 patented Aug. 26, 1975 by A. J. Mulder provided a plastic baby crib construction having two crib-sides connected to two crib-ends made of cross-members and upright members having a uniform lateral cross-section. The structural members were hollow, substantially-rectangular extrusions having opposing side walls and end walls, and four smoothly rounded corners. Two partitions extended longitudinally of, and were spaced within, the hollow extrusion to define three longitudinal channels within the extrusion. A T-shaped member was used to connect the crib-sides to the crib-ends to permit them to slide vertically, the head of the T-shaped member sliding within one of the channels.

U.S. Pat. No. 3,979,783 patented Sept. 14, 1976 by A. D. Spencer provided a crib or youthbed comprising headboard, footboard, and side subassemblies, each such side subassembly carrying mating connecting half-parts for the quick and easy assembly and/or disassembly of the subassemblies without the necessity for supportive tools. That knockdown crib included slip joint coupling means fixed to each of the end walls of each of the subassemblies. The coupling means of each end wall of each subassembly was intercoupled with the coupling means of the end wall of the respective adjacent subassembly. The coupling means for slip-jointing each end wall of each headboard and footboard subassembly and respective adjacent end wall of each side subassembly included mating complemental half-parts in each of the end walls and latch means on one of the half-parts.

U.S. Pat. No. 4,285,079 patented Aug. 25, 1981 by E. C. Hillman provided a crib having a main frame, a generally horizontal mattress support, and a mattress carried by the support. The mattress and the support could be raised and lowered within the main frame by flexible hoist members attached to a winding bar that was rotatably journaled in two housings. The hoist members were secured by brackets to a spring frame that formed part of the mattress support.

(iii) Aims and Objectives and Deficiencies of the Prior Art

It is seen therefore that the prior art discussed above addressed many problems. The above described prior art patents attempted to provide a structure which could be readily converted to provide a bed or a crib.

The above-described prior art patents attempted to provide a crib which could be easily and quickly extended in length to accommodate a growing child and whilst maintaining a pleasing and neat appearance.

The above-described prior art patents attempted to provide a baby crib which could be shipped in parts and which could quickly and easily be assembled without the necessity of any tools.

The above-described prior art patents attempted to provide a crib having a sliding gate on one or both sides thereof and yet which did not require stabilizing bars or other supplemental stiffeners for its end panels.

The above-described prior art patents attempted to provide a baby crib having means for suspensing a bed spring therein which could be positioned at any one of a plurality of levels, so that the spring could be located at an upper level for a very young baby, and progressively lowered to different levels as the baby grew older, yet in which there was to be no danger of the spring becoming accidently dislodged.

The above-described prior art patents attempted to provide a baby crib having a sliding gate or gates which could be easily slipped into place when the crib was first dissembled, but which could not move upwardly beyond a certain position when the crib was in use.

The above-described prior art patents attempted to provide a crib having at least one drop side and extension means associated with this side to raise the effective level thereof to a point at which a child could not climb thereover.

The above-described prior art patents attempted to provide apparatus for securing the sides of the cribs firmly in position without screws or other similar fastening means.

The above-described prior art patents attempted to provide a crib construction which can be easily covered to prevent an infant from climbing out of or into the crib.

The above-described prior art patents attempted to provide a crib specially constructed to reduce the risk of injury to an infant sleeping in a crib due to the construction of the crib.

The above-described prior art patents attempted to eliminate the need for separate crib bumpers for a crib.

The above-described prior art patents attempted to provide an infant's crib which may be readily folded-up when not in use.

The above-described prior art patents attempted to provide a child's bed or crib which could be converted into use as a play pen when desired.

The above-discussed prior art patents also attempted to provide simple means for detachably connecting a mattress frame to a crib supporting structure without the use of any tools or any other loose parts, which itself had no parts that need to be removed as the frame was connected and disconnected, which was operable to detachably lock the frame to the crib supporting structure in all directions so as to produce a rigidifying influence on the crib structure sufficient to hold the same secure against racking, and which, when the frame was disconnected, could have its movable parts foldable substantially into the confines of the crib components which is adapted to interconnect, so as to permit the components to be crated compactly for shipment.

The above-discussed prior art patents also attempted to provide a removable fabric support sling for a crib, or play-pen which was maintained in place by keeper bars positioned outside of the crib and which passed through loops provided on the support sling.

The above-discussed prior art patents also attempted to construct the crib with a durable main frame having its ends and sides permanently and rigidly interconnected to provide a long service life.

The above-discussed prior art patents also attempted to provide a crib structure which facilitated the raising of the auxiliary frame from its normal lower level to its upper level and which would reduce to a minimum the physical effort involved, even when the auxiliary frame carried the weight of a baby.

The above-discussed prior art patents also attempted to insure that the side rails were of sufficient height to provide adequate protection against the child's tendency to climb over it, to provide adjustability of the height of the spring-frame, so that the latter may be conveniently lowered from time to time as the child grows, and to provide detachable support means for the spring on the crib frame as will not only permit ready adjustability but will at the same time insure against accidental detachment as a result of the child's jumping.

The above-discussed prior art patents also attempted to provide means for detachably mounting a spring on a crib frame which will practically insure against rocking movement of the spring when repeatedly jumped upon by a small child and will also insure against accidental detachment due to such violent action.

The above-discussed prior art patents also attempted to provide an improved crib which may be manufactured substantially of a relatively few molded plastic components.

The above-discussed prior art patents also attempted to provide a method of rapidly assembling a crib so that ready assembly of the components could be rapidly achieved by even the most technically unskilled person.

The above-discussed prior art patents also attempted to provide an improved mechanism for raising and lowering the mattress of the crib that was of reduced complexity and expense yet was easily and conveniently operated.

SUMMARY OF THE INVENTION (i) Aims of the Invention

However a problem of the cribs of the prior art having an adjustable support system was that, occasionally, the adjustable mattress support system became dislodged and the baby was trapped between the loose mattress and the side of the crib, resulting in the death of the baby. On the other hand, it is still desirable to be able to adjust the mattress height to accommodate the various heights of babies using the crib. Moreover new safety standards in Canada have made many such previous adjustable cribs unsatisfactory.

Accordingly it is an object of this invention to provide a crib which includes mattress height adjustment means and yet is able to meet new safety standards.

(ii) Statement of Invention

The crib of a broad concept of the present invention comes in four main pieces, including the mattress, and no tools are needed to set it up, yet it does away with the conventional mattress support system used in most cribs now. The crib includes a mattress-supporting board that is retained in grooves in the frame of the crib. To adjust the mattress height from near the top of the crib for a newborn to a lower setting for a baby that can stand, the crib is simply turned upside down.

By this invention then, a crib is provided comprising (a) a generally rectangular, fixed-height back wall, the back wall including an upper horizontal face, a lower horizontal face, an inner face, an outer face and a pair of lateral faces, each lateral face having an outwardly facing surface; (b) a pair of generally rectangular end gables, each end gable including an upper horizontal face, a lower horizontal face and a pair of lateral end faces, the end gable including an inwardly-facing surface and an outwardly-facing surface, each end gable being hingedly connected to an associated lateral face of the fixed-height back wall; (c) at least two grooves within the inwardly facing surface of each of the end gables, each of the grooves of one gable being on the same horizontal plane as an associate groove in the other gable; (d) a mattress support having a specified rigidity selectively movably retained within selected grooves in the same horizontal plane in each of the end gables; (e) a generally rectangular, slidable dropside front wall disposed between the inwardly-facing surfaces of the end gables, the slidable dropside front wall being vertically slidable between a vertical upper limit and a vertical lower limit, the slidable dropside front wall including an upper horizontal face, a lower horizontal face, and a pair of lateral faces, each lateral face having an outwardly facing surface; and (f) cooperating vertically-extending guide means between an inwardly facing surface of the lateral end faces of each end gable and the vicinal outwardly facing surface of the lateral faces of the slidable dropside front wall to permit relative vertical movement of the slidable dropside front wall while preventing relative horizontal movement between the slidable dropwise front wall and the end gables. In such crib, the vertical space between the mattress and the top of the slidable dropside front wall may be adjusted by firstly raising and removing the dropside front wall, removing the mattress support out of one the cooperative grooves in each of the end gables, then inserting the mattress support into a second selected cooperative groove in each of the end gables, and finally reinserting the dropside front wall to hold the crib together in its rigid, assembled form.

By this invention as well, a crib is provided comprising (a) a generally-rectangular fixed-height back wall, a back wall including an upper horizontal face, a lower horizontal face, an inner face, an outer face and a pair of lateral faces, each lateral face having an outwardly facing surface; (b) a pair of generally rectangular end gables, each end gable including an upper horizontal face, a lower horizontal face and a pair of lateral end faces, the end gable including an inwardly-facing surface and an outwardly facing surface, each end gable being of the same height, each end gable being hingedly connected to an associated lateral face of the fixed-height back wall in such a manner that one end gable is displaced vertically with respect to the other end gable; (c) a single groove within the inwardly facing surface of each of the end gables, the groove being spaced an unequal distance between the upper horizontal surface and the lower horizontal surface of the end gables; (d) a mattress support having a specified rigidity selectively movably retained within the groove; (e) a generally rectangular, slidable dropside front wall disposed between the inwardly-facing surfaces of the end gables, the slidable dropside front wall being vertically slidable between a vertical upper limit and a vertical lower limit, the slidable dropside front wall including an upper horizontal face, a lower horizontal face, and a pair of lateral faces, each lateral face having an outwardly facing surface; (f) cooperating vertically-extending guide means between an inwardly facing surface of the lateral end faces of each end gable and the vicinal outwardly facing surface of the lateral faces of the slidable dropside front wall, to permit relative vertical movement of the slidable dropside front wall while preventing relative horizontal movement between the slidable dropside front wall and the end gables; and (g) a pair of wheels or castors removably attached to the end gable which is displaced vertically higher with respect to the fixed-height back wall than the other gable, whereby said crib is horizontally level. whereby the crib is vertically oriented. In such crib, the vertical space between the mattress and the top of the slidable front wall is adjusted merely by inverting the crib, since the mattress support is disposed an unequal distance between the top and the bottom of the end gables and the back wall. The castors are then removed from the top of one end gable and inserted at the bottom of the other end gable to provide a vertical orientation of the crib.

(iii) Other Features of the Invention

In the first embodiment of the invention, at least two grooves are also provided within the inner face of the fixed-height back wall, the grooves being of the same horizontal plane as associated grooves in the end gables, thereby to provide at least two horizontally-contiguous grooves.

In this embodiment of the invention, the cooperating means may comprise a dovetail tongue on the inwardly-facing surface of the lateral end faces of each end gable, and a dovetail groove in the vicinal outwardly-facing surface of the lateral faces of the slidable dropside front wall. In this first embodiment of the invention, the slidable dropside front wall is secured in its vertical upper limit by means of a spring-loaded barrel bolt which can only be withdrawn following slight upward movement of the slidable dropside front wall and vertically-inward slidable movement of the bolt. In addition, in this first embodiment of this invention, the vertical upper limit of the slidable dropside front wall is provided by a spring-loaded pin mounted in one end gable, the pin being adapted to abut the upper horizontal face of the slidable dropside front wall. Furthermore, the in this first embodiment of the invention, the vertical lower limit of the slidable dropside front wall is provided by a spring-loaded pin mounted in one end gable, the pin being adapted to abut the lower horizontal face of the slidable dropside front wall.

In the second embodiment of the invention, a single groove is also provided within the inner face of the fixed-height back wall, that groove being of the same horizontal plane as the grooves in the end gables, thereby to provide one contiguous groove.

In this second embodiment of the invention, as well, the cooperating means comprises a dovetail tongue on the inwardly-facing surface of the lateral end faces of each end gable, and a dovetail groove on the vicinal outwardly-facing surface of the lateral faces of the slidable dropside front wall. Also in this second embodiment of the invention, the slidable dropside front wall is secured in its the vertical upper limit by means of a spring-loaded barrel bolt which can only be withdrawn following slight upward movement of the slidable dropside front wall and vertically-inward slidable movement of the bolt. Furthermore, in this second embodiment of the invention, the vertical limit of the slidable dropside front wall is provided by a spring-loaded pin mounted in one end gable, the pin being adapted to abut said upper horizontal face of the slidable dropside front wall. In addition, in the second embodiment of the invention, the vertical lower limit of the slidable dropside front wall is provided by a spring-loaded pin mounted in one end gable, the pin being adapted to abut the lower horizontal face of the slidable dropside front wall.

There are two alternative structures of the generally rectangular fixed wall and dropside front wall by further features of this invention. In one structure, the back wall and the dropside front wall are each provided within a framework comprising a pair of vertically spaced-apart stiles, a pair of horizontally spaced-apart rails and a plurality of closely-spaced, vertically-oriented, spaced-apart slats disposed between the stiles and extending between the rails. In another structure, the back wall and the dropside front wall are each provided within a framework comprising a pair of vertically spaced-apart stiles, a pair of horizontally spaced-apart rails, a plurality of widely-spaced parallel bars disposed between the stiles and extending between the rails, and a plurality of strong, transparent, synthetic plastic panels disposed between each pair of adjacent stile and bars, and extending between the rails.

In another feature of the invention, the mattress support preferably is a sheet of plywood about ¾" in thickness. By yet another feature of the invention, the grooves are coordinated with the mattress support and, in such mattress support ¾" in thickness are about ¾" in height and ⅜" in depth. By a more general feature of this invention, the ratio of mattress support thickness/-groove depth is 1/1 for flexible materials to 2/1 for rigid materials, "flexible" being a material having a maximum deflection as defined in Test C hereinafter of more than about 150 mm and "rigid" being a material having a maximum deflection as defined in Test C hereinafter of about 150 mm or less.

In another feature of this invention, the grooves are formed only in the end gables and are of less than ⅜" in depth but are covered by a plate having a longitudinally-extending slot to provide a channel about ⅜" depth. The end faces of the mattress support are provided with a plurality of bolts, the heads of which are adapted to rest within the channel, the shanks of which are adapted to slide within the slot. The characteristics of the mattress support are, however as defined above.

By yet another broad feature of this invention, the crib consists of a number of essential, interrelated elements. The crib includes a fixed-height back wall hingedly connected to each of two end gables, which, in the preferred embodiment are interconnected in such a way as to appear to be of different heights, while wheels or castors are provided only in the end gable which seems to be of the lower height. At least one groove, and preferably only one such groove, is provided within the inner faces of the hingedly connected end gables, and optionally also within a cross brace in the back wall. The groove is preferably disposed within the cross-brace of the end gables. If more than one groove is provided, then more than one cross-brace would also be provided. Within this groove, a mattress support having the above described specified rigidity is adapted to be retained. The hingedly-connected back side wall and the end gables, with the mattress support embraced thereby, are held together to form a rigid unit by means of a slidable dropside front wall, preferably sliding in a vertical tongue provided on each of the inner faces of the vicinal end gables and cooperating with a groove in the vicinal end faces of the slidable dropside front wall, or vice versa. Preferably, the tongue and groove are a mating dovetail tongue-and-groove unit. The height adjustment of the slidable front wall is provided by a spring-loaded barrel bolt which can only be withdrawn following slight upward movement of the front wall while sliding the bolt horizontally inwardly. Upper and lower limit of sliding movement of the slidable dropside front wall is provided by cooperation of the upper and lower rails respectively with spring loaded pins set into diametrically opposed faces of vicinal end gables.

In one preferred feature of this invention, the crib includes a mattress-supporting board that engages with a single groove in each of the end gables of the crib, the groove being an unequal distance between the top and the bottom of the end gables. To adjust the mattress height from near the top of the crib for a newborn to a lower setting for a baby that can stand, the crib is simply turned upside down, with a suitable re-placement of the wheels or castors.

BRIEF DESCRIPTION OF THE DRAWINGS

In the accompanying drawings.

Figure 1:
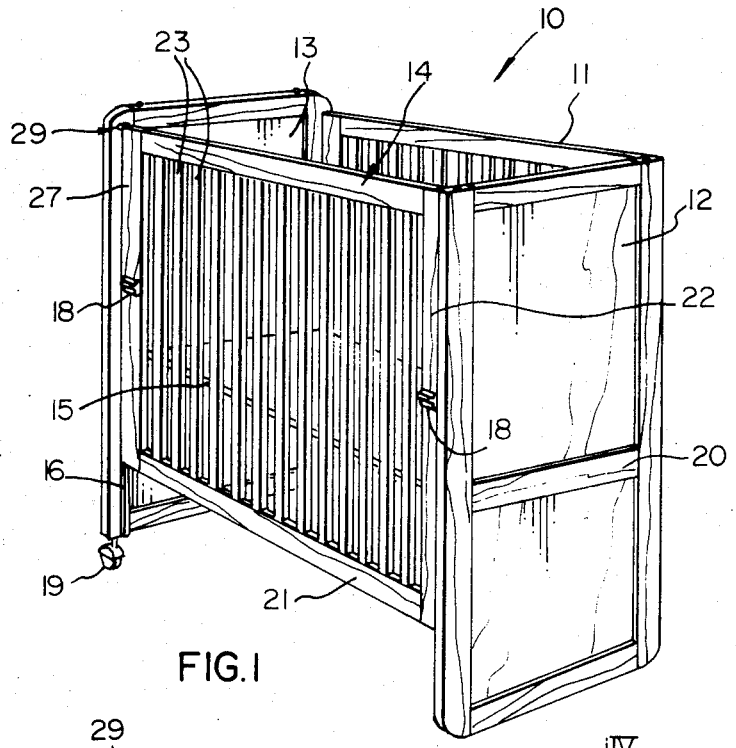
FIG. 1 is a perspective view of the crib of one embodiment of this invention.
Figure 2:
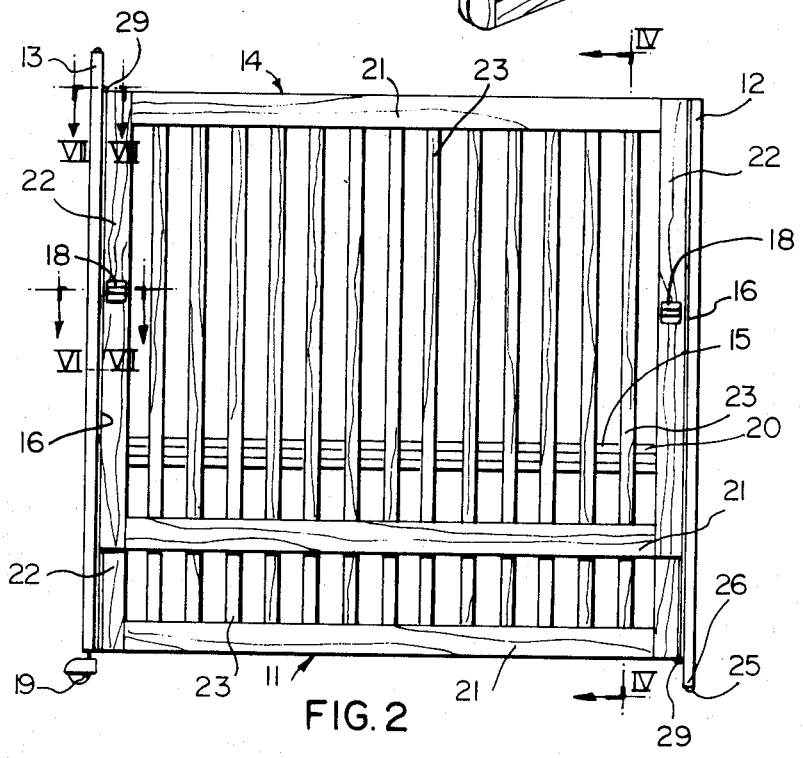
FIG. 2 is a front elevational view of the embodiment of this invention depicted in FIG. 1, with the vertically-movable dropside wall in its raised position.
Figure 3:
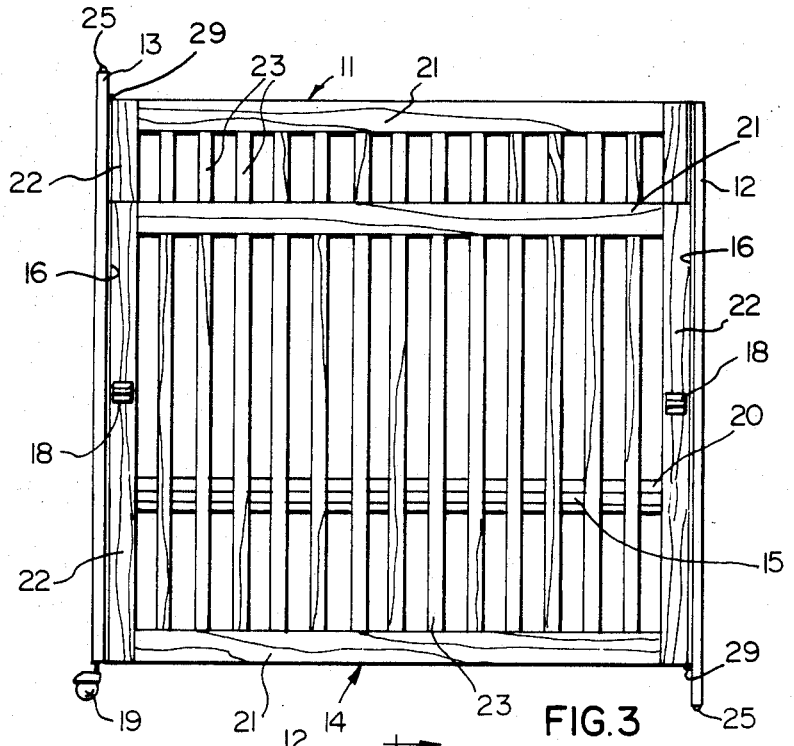
FIG. 3 is a front elevational view of the embodiment of this invention depicted in FIG. 1, with the vertically-movable dropside wall in its lowered position.

DESCRIPTION OF PREFERRED EMBODIMENTS (i) Description of FIGS. 1, 2 and 3

As seen in FIGS. 1, 2 and 3, the crib 10 of one embodiment of this invention includes a fixed back side wall 11, a pair of end gables 12 and 13, a slidable, dropside front wall 14 and a fixed mattress support 15. The slidable dropside front wall 14 is slidable within a dovetail tongue-and-groove system 16,17. The slidable dropside wall 14 is held in its upper position, as shown, by a pair of lateral dropside locks 18 (to be described in detail hereinafter). Limit of upward and downward movement of the slidable dropside front wall 14 is provided by cooperation with safety-stops 29, (to be described in greater detail hereinafter).

It is seen that, in its assembled form, it appears that end gables 12, 13 are of different heights, since end gable 13 projects above the upper edge of end gable 12, and since end gable 12 projects below the lower edge of end gable 13. The assembled crib 10 is maintained in a horizontal orientation by means of two selectively insertable castors or wheels 19 under end gables 13. In other words, as seen in FIGS. 1, 2 and 3, end gable 12 projects below the lower edge of end gable 13 by an amount equal to the height of the castors or wheels 19.

It is also seen that end gable 12 (and while not seen, also end gable 13) and optionally also back side wall 11 is provided with a cross-brace 20 whose purpose will be explained later. In addition, both back side wall 11 and slidable dropside wall 14 are in the form of a framework comprising upper and lower horizontally-spaced-apart rails 21, and lateral, vertically-spaced-apart stiles 22, the rails 21 being interconnected by a plurality of spaced-apart, parallel vertical slats 23.

Figure 4:
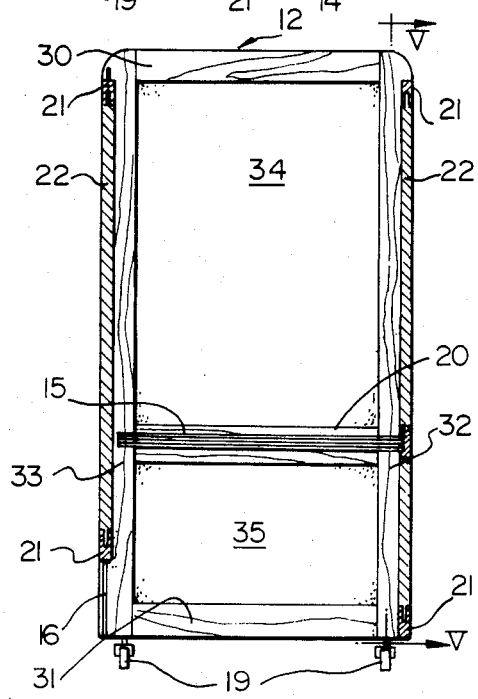
FIG. 4 is an end cross-section, taken along the line IV—IV of FIG. 2.
Figure 5:
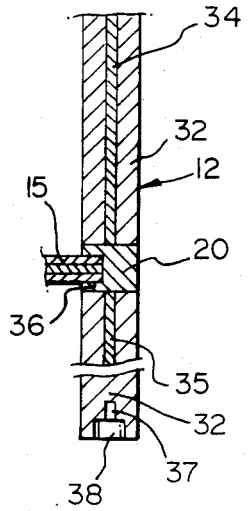
FIG. 5 is a vertical cross-section, taken along the line V—V of FIG. 4.

(ii) Description of FIGS. 4 and 5

As seen in FIGS. 4 and 5, each end gable 12, 13 includes a framework of upper and lower, horizontally-spaced-apart rails 30, 31 and lateral, vertically-spaced-apart stiles 32, 33, a cross-brace 20, and one thin panel 34, set therein between rail 30, stiles 32, 33 and cross-brace 20, and a second thin panel 35 set therein between cross-brace 20, stiles 32, 33 and rail 31. If more than one groove 36 is desired, more than one cross-brace 20 is provided. Mattress support 15, in the form of a plywood panel having the flexibility characteristics described hereinabove is fixedly held within grooves 36 formed within cross-braces 20, and optionally also within a similar groove formed in back side wall 11. The groove 36 is spaced so that it divides the end gables 12, 13 and, if in the back side wall 11, also within the back side wall 11 into a division calculated to meet the safety standards to be described hereinafter. One example of such division is a $\frac{3}{4}$–$\frac{1}{4}$ division. An additional purpose of such division will be described later.

One end of each of lateral stiles 32, 33 is provided with wells in the form of a main bore 37 and countersunk bore 38. The diameters of bores 37 and 38 are so selected that they are considerably larger than the diameter of a finger of a baby, so that it would not be possible for a baby to injure himself by jamming a finger thereinto. The other end of each of lateral stiles 32, 33 is provided with wells within which are permanently glued dowels 25 to provide feet for the respective end gable 12, 13.

Figure 6:
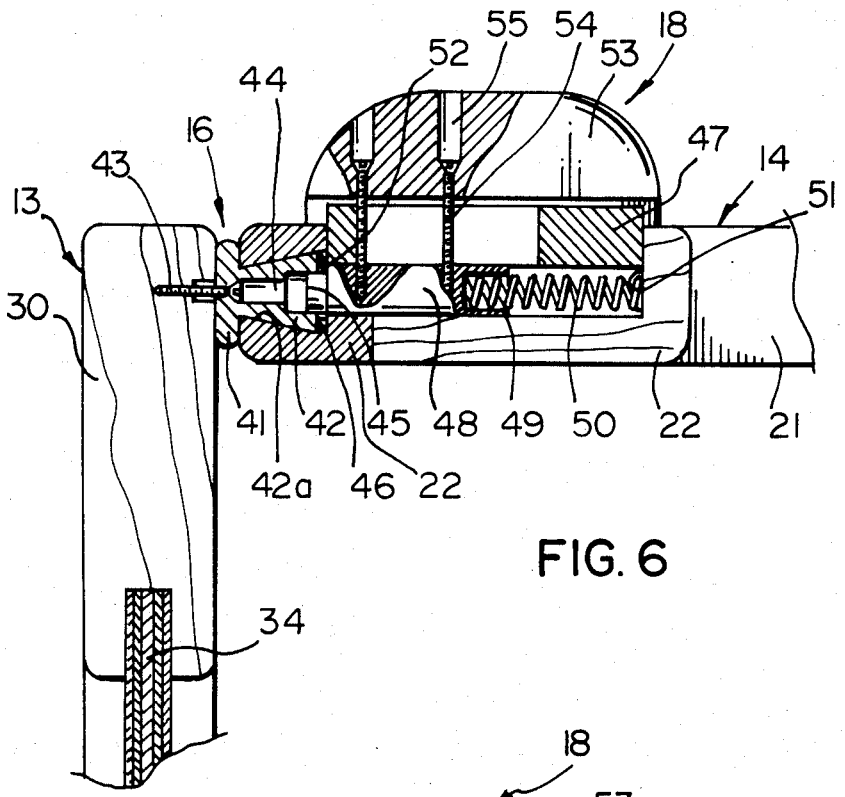
FIG. 6 is a horizontal cross-section of the dropside lock and auxiliary structure taken along the line VI—VI of FIG. 2.

(iii) Description of FIG. 6

As seen in FIG. 6, the dropside front wall 14 is provided with a pair of dropside locks 18 (only one of which being seen in FIG. 6) and with groove 17 of the tongue-and-groove assembly 16, 17. The lateral vertical region of the inner face of each lateral stile 30 of each end gable 12, 13 is provided with a tongue 16. As seen in FIG. 6, such tongue 16 is in the form of a vertically-extending plate 41, provided with a vertically-extending dovetail extension 42. The lateral vicinal face of stile 22 is provided with a vertically-extending mating dovetail groove 42*a*. Tongue 16 is secured to stile 30 by means of screws 43 engaged through bores 44 in extension 42.

Tongue 16 is also provided with the female portion of the dropside lock assembly 18. Such female portion includes a bore 45, covered by a plate 46 having a key-hole-shaped aperture.

Dropside lock assembly 18 includes a main body 47 inset partially within stile 22 of dropside front wall 14. Main body 47 provides a guide for pin 48 which is provided with a well 49 within which one end of a compression spring 50 is adapted to be disposed. The other end of compression spring 50 abuts end 51 of the inset within stile 22. Pin 48 is urged to enter the key-hole-shaped opening 52 of plate 46 when properly aligned and then enters bore 45. A handle 53 is secured to body 47 by means of screws 54 within bores 55.

Figure 7:
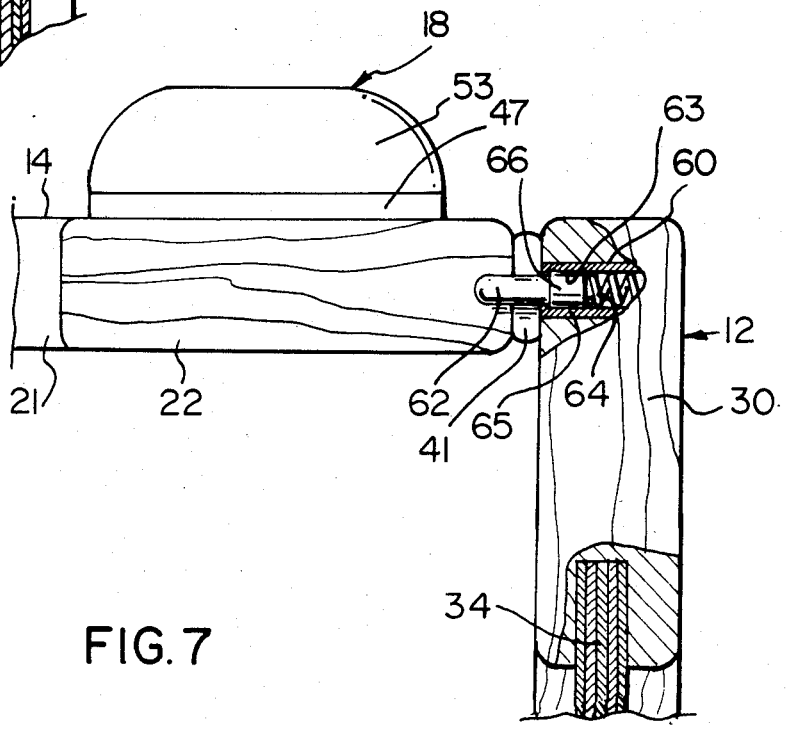
FIG. 7 is a horizontal cross-section of the safety-stop and auxiliary structure taken along the line VII—VII of FIG. 2.

(iv) Description of FIG. 7

As seen in FIG. 7, safety stop assemblies 29 are provided to limit both the uppermost movement and the lowermost movement of the slidable dropside front wall 14. One safety stop assembly 29 is provided at the upper left hand corner within the face of end gable 13 (as seen in FIG. 2) and a second safety step assembly is provided in the lower right hand corner with the face of end gable 12 (as seen in FIG. 2). The relative position of these safety stop assemblies is unchanged even if the crib is inverted, as will be described hereinafter.

The safety stop 29 includes a housing 65 disposed within bore 60 in stile 30, and is provided with a stop pin 62 slidably fitted within a bore 63 within housing 65, and is resiliently urged therein with its larger diameter end 66 abutting end plate 67 of housing 65 by means of compression spring 64, which abuts between the inner face of the bore 60 in stile 30, and the end of pin 62. Pin 62 of the upper safety stop assembly 29 is adapted to abut the upper surface of upper rail 22, while pin 62 of the lower safety stop assembly is adapted to abut the lower surface of lower rail 24. Pin 62 may be manually urged inwardly to enable release of the slidable dropside front wall 14 to enable removal thereof.

Figure 8:
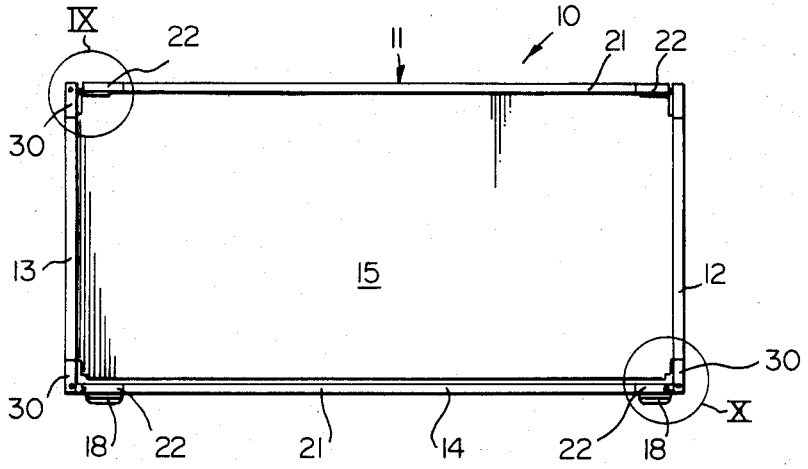
FIG. 8 is a top plan view of the embodiment of this invention depicted in FIG. 1.
Figure 9:
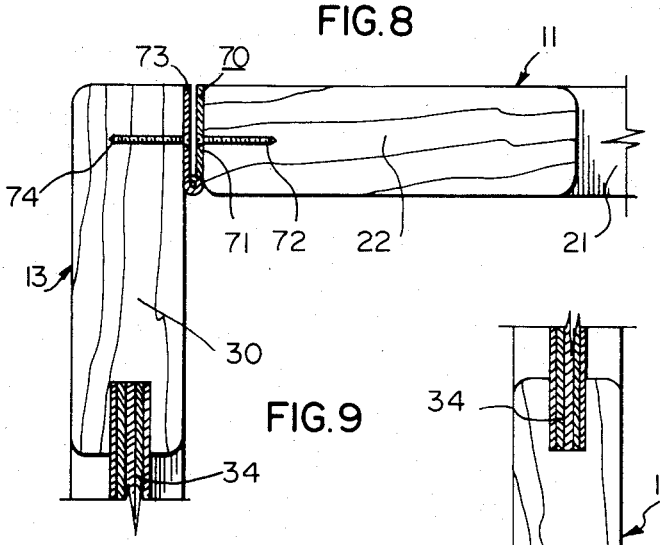
FIG. 9 is an enlarged view, partly in horizontal section, of the hinged back wall and end gable assembly within the circle IX of FIG. 8.
Figure 10:
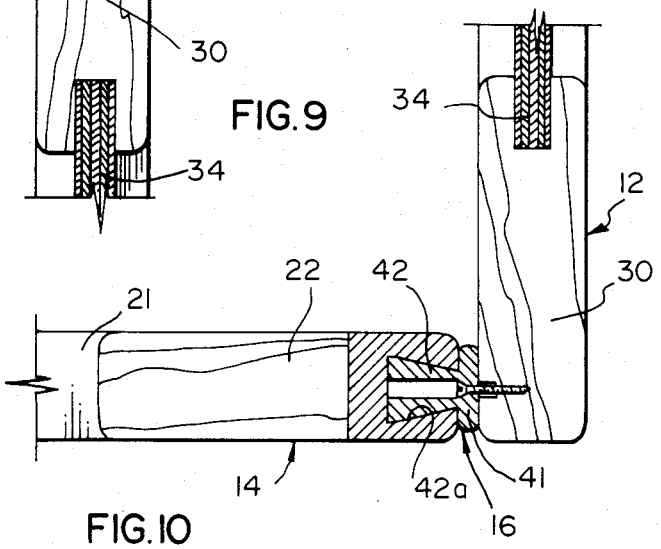
FIG. 10 is an enlarged view, partly in horizontal section, of the tongue-and-groove slide assembly within the circle X of FIG. 8.

(v) Description of FIGS. 8, 9 and 10

FIG. 8 shows a top plan view of the assembled crib and FIGS. 9 and 10 show details thereof. As seen in FIG. 9, back side wall 11 is hingedly attached to end gable 13 by means of a continuous piano hinge 70, one plate 71 of which is secured to the outer vertical face of stile 22 of back side wall 11 by means of screws 72, while the other plate 73 of which is attached to the inner vertical face of stile 30 by means of screws 74.

FIG. 10 is basically a recapitulation of FIG. 6 and shows how the dropside front wall 14 is slidably but securely mounted to end gables 12, 13 (only end gable 12 being shown). This is shown by means of the dovetail tongue-and-groove assembly provided by dovetail projection 42 on plate 41 of tongue 16 and secured to stile 30 and mating dovetail groove **42*a* formed within stile 22**. While dovetails have been shown, any other type of interconnection which allows sliding movement while prohibiting extension separation may be used, for example "T" cross-section tongue-and-groove assemblies may be used.

Figure 11:
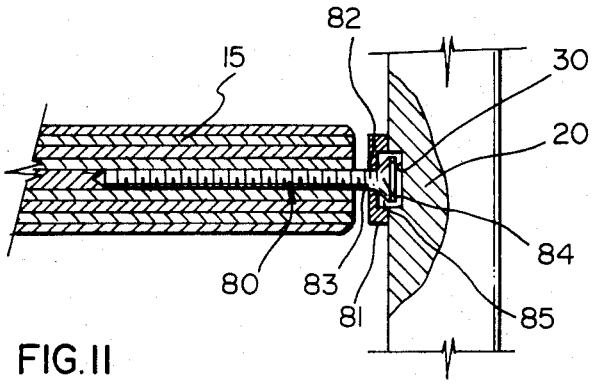
FIG. 11 is a transverse cross-section of a locking structure forming part of the mattress support assembly for use in the embodiment of this invention depicted in FIG. 2.

(vii) Description of FIG. 11

FIG. 11 shows the locking structure of the mattress support. In this embodiment, the forward portion of the lateral end faces of the mattress support 15 is provided with at least one screw 80. The groove 36 within cross-brace 20 is shallow but is covered by a plate 81 which is U-shaped in cross-section and which is provided with a longitudinally-extending slot 82. The shank 83 of screw 80 is adapted to slide within slot 82, while the head 84 of the screw 80 is adapted to fit within chamber 85 defined in part by groove 36. This retains the mattress support within the end gables.

Figure 12:
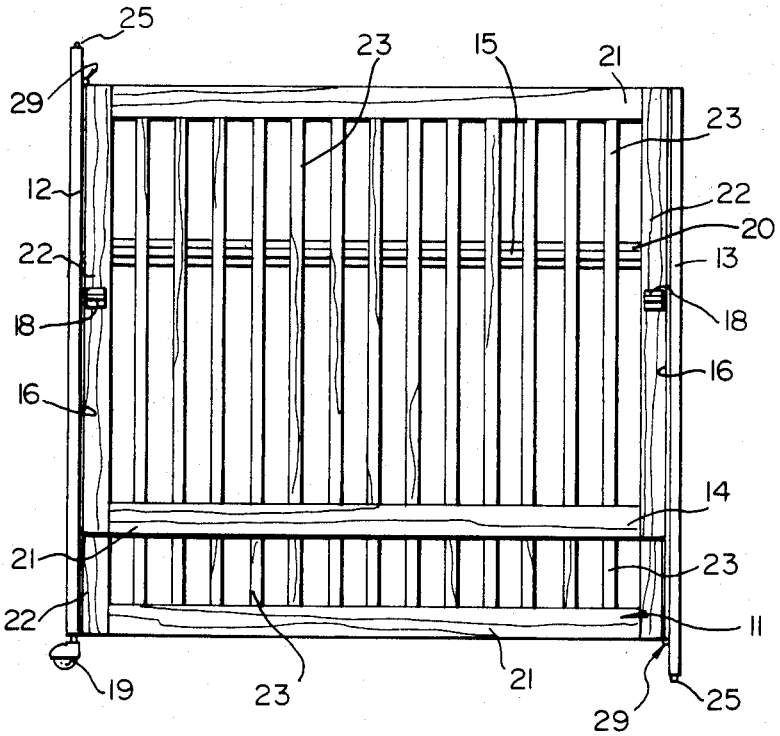
FIG. 12 is a front elevational view of the embodiment of the invention depicted in FIG. 2 in inverted position to provide a different height of mattress support.

(viii) Description of FIG. 12

FIG. 12 shows how the height of the mattress support 15 may be varied according to one preferred embodiment of this invention. In this embodiment, the castors or wheels 19 are removed from their nest within bores 37, 38 provided in end gable 13 (as seen in FIG. 2) and the entire crib is inverted. Castors or wheels 19 are then inserted in their nest within bores 37, 38 provided in end gable 12. The feet previously provided at the base of end gable 12, i.e. dowels 25 having an outwardly projecting arcuate end face and glued within an aperture (not seen) therein now presents an upper, safe projection on end gable 12. Dowel 25 within an aperture (not seen) in end gable 13, now provides the feet.

While height adjustment is preferred to be made by inverting of the crib 10, it is equally feasible to provide two or more grooves 36 within cross-braces 20 and to vary the height of the mattress support 15 by disassembling the dropside front side 14, removing the mattress support 15 from one set of grooves, and then reinserting the mattress support into a second set of grooves. Then the crib is reassembled by reassembling dropside front side 14 using the dovetail tongue-and-groove assembly 16, 17.

Figure 13:
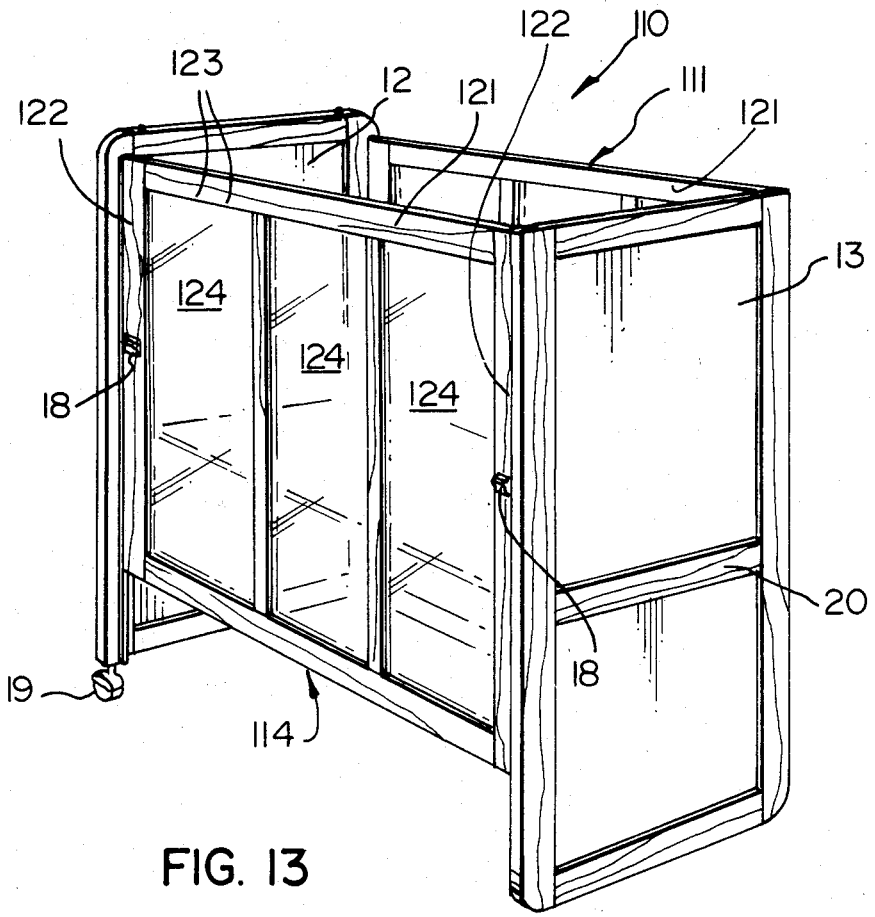
FIG. 13 is a perspective view of the crib of a second embodiment of this invention.

(ix) Description of FIG. 13

FIG. 14 shows a second embodiment 110 of the crib of this invention. In this embodiment, back side wall 111 and dropside front wall 114 are each formed with top rails 121 and lateral stiles 122. Instead of the plurality of slats 23, however, two spaced-apart vertical divider bars 123 are provided, and between the respective adjacent vertical divider bars 123 and/or stiles 122 plastic plates 124 are set. All other features of the crib 110 are the same as described herein above for crib 10.

DESCRIPTION OF THE NEW CRIB SAFETY STANDARDS

As mentioned previously, new Canadian governmental standards are being developed for cribs; while these regulations have not yet been promulgated, it is believed that the heart of the safety feature will be embodied by the following regulations.

1. No standard crib or cradle shall have its mattress support system deform permanently, or disengage, nor have its mattress support dislodge when tested in accordance with the following test for the mattress support system;

A. The method to be used for testing the mattress support system is as follows:

(a) omitting accessories which could hinder the implementation of the test, assemble the standard crib according to the manufacturer's recommended instructions;

(b) secure the crib to a horizontal surface in a manner that does not impede the test;

(c) apply, for a period of one minute, an upward force at one corner of the mattress support, within 150 mm from the two sides forming the corner, such that a force of 250 N is applied on the mattress support mechanism;

(d) note any dislodging of the mattress support, or disengagement or deformation of any mattress support mechanism;

(e) repeat (c) and (d) at the other corners of the mattress support;

(f) apply, for a period of one minute, an upward force, as close as possilbe to each corner of the mattress support, such that a force of 250 N is applied simultaneously to each mattress support mechanism;

(g) note any dislodging of the mattress support, or disengagement or deformation of any mattress support mechanism;

(h) apply a force of 200 N on one of the mattress support mechanisms in a manner that will facilitate disengaging the mattress support mechanism;

(i) note any dislodging of the mattress support, or disengagement or deformation of any mattress support mechanism;

(j) repeat (h) and (i) on the remaining mattress support mechanisms;

(k) apply a force of 200 N in any direction and at any point on one of the mattress support mechanisms in manner that could cause a deformation of the mechanism or any component thereof;

(l) note any dislodging of the mattress support, or disengagement or deformation of any mattress support mechanism; and (m) repeat (k) and (l) on the remaining mattress support mechanisms.

2. Any latching or locking mechanism other than the mattress support mechanisms:

(i) shall require two separate, positive and simultaneous actions on the part of the user to release the mechanism; and (ii) shall engage automatically.

3. For every standard crib, the distance between the upper surface of the mattress in its lowest position and the upper surface of any panel, whichever is lower, in its highest position shall be not less than 660 mm.

4. For every standard crib, the distance between the upper surface of the mattress support in its highest position and the upper surface of any panel, whichever is lower, in its lowest position shall not be less than 230 mm.

5. No product shall have the lower surface of its panels in any position higher than the upper surface of the mattress support in its lowest position.

6. For every product so manufactured, the space between any bar, side, rail, slat, spindle, rod, post or other similar component and any adjacent component of the product including the whole or part of any other opening above theupper surface of the mattress support at its lowest position shall not permit the passage of a solid rectangular block 60 mm×100 mm×100 mm in any orientation, without being forced, through the space, when tested in accordance with the following test for spacing between product components;

B. The method to be used for testing the spacing between the product components is as follows:

(a) assemble the product according to the manufacturer's recommended instructions;

(b) adjust the mattress support to its lowest position, if the mattress support is adjustable;

(c) place a right triangular prism-shaped metallic lodging wedge having a length of 120 mm, a width of 40 mm a height of 50 mm and a longitudinal cross-section in the form of a trapezoid, between a bar, rail, slat, spindle, rod, post or other similar component of a product and any adjacent component of a product midway along the greatest dimension of the space;

(d) apply a pull of 90 N for 10 seconds on the eyebolt of the loading wedge in a direction perpendicular to a plane passing through the points of contact of the wedge with the two components;

(e) attempt to pass, without forcing, a solid rectangular block of dimensions 60 mm×100 mm×100 mm through the space, anywhere above or below the lodging wedge;

(f) repeat (e) with the blok in different orientations; and (g) repeat (c) to (f) for all other spaces between other bars, rails, slats, spindles, rods, posts and adjacent components.

7. Every corner post assembly in a standard or portable crib shall be designed in such a manner that no part of the corner post assembly protrudes more than 3 mm above the upper edge of any panel, whichever is higher, when measured from the lowest point on the upper edge of the higher panel within 70 mm from the center line of the post.

8. No product shall have shapes, projections, attachments or mechanisms above the upper surface of the mattress support which could cause or lead to the entanglement of any clothing or garment accessories the occupant of the product is wearing.

9. No standard crib shall have any visible signs of damage, disengagement or deformation when tested in accordance with the following tests for structural integrity.

C. The method to be used for testing the integrity of standard cribs under dynamic conditions is as follows:

(a) assemble the crib according to the manufacturer's recommended instructions;

(b) secure the crib to a horizontal surface in a mammer that does not impede the test;

(c) place, on the mattress support, a 100 mm thick sheet of polyurethane foam having a density of 30 kg/m$^3$ and having the required length and width;

(d) use a 20 kg test load, 200 mm in diameter, 260 mm bottom curvature having a radius of 260 mm and with cambered edges having a radious of 5 mm;

(e) allow the test load to fall freely from a height of 150 mm, 150 times at a rate of one impact per second, at the geometric centre of the upper surface of the polyurethane foam;

(f) note any visible signs of damage to the crib, or disengagement or deformation of any latching or locking mechanism;

(g) repeat (e) and (f) at each corner of the mattress support such that the centre of the test load is 150 mm frrm the two sides forming the corners; and (h) repeat (e) and (f) at the mid point along the edge of the mattress support, on the adjustable side if the product has an adjustable side, or on any adjustable side if the product has more than one adjustable side, such that the test load is 150 mm from that side.

D. The method to be used for testing the integrity of standard cribs under horizontal force conditions is as follows:

(a) assemble the crib according to the manufacturer's recommended instructions;

(b) secure the crib to a horizontal surface in a manner that does not impede the test;

(c) with the adjustable side or sides in the fully raised position, if the crib has an adjustable side or sides, apply an alternating horizontal force of 120 N in the transverse direction on the top of one side, at the mid point, not more than 50 mm from the top of the side being tested, at a frequency of no less than 150 cycles per minute for one hour; a total of 9000 cycles;

(d) note any visible signs of damage to the crib, or disengagement or deformation of any latching or locking mechanism; and (e) repeat (c) and (d) for the remaining sides of the crib.

E. The method to be used for testing the integrity of standard cribs under vertical force conditions is as follows:
(a) assemble the crib according to the manufacturer's recommended instructions;
(b) secure the crib to a horizontal surface in a manner that does not impede the test;
(c) with the adjustable side or sides in the fully raised position, if the crib has an adjustable side or sides, apply a downward vertical force of 120 N on the top of one side at a frequency of no less than 150 cycles per minute for one hour;
(d) note any visible signs of damage to the crib, disengagement or deformation of any latching or locking mechanism; and
(e) repeat (c) and (d) for the remaining sides of the crib.

10. Every component of a product that is small enough to be placed in a truncated right cylinder having a diameter of 32 mm, a minimum depth of 25 mm and a maximum depth of 57 mm shall be so fitted or affixed to the product that the component will not become detached from the product when subjected to a force of 90 N applied in any direction.

11. Where it is so manufactured, no standard crib shall have any of its slats, bars, rails, spindles, rods, or posts turn, disengage, deform, damage or deflect when tested in accordance with the following test for slat strength;

F. The method to be used for testing the strength of slats of a standard or portable crib is as follows:
(a) assemble the crib according to the manufacturer's recommended instructions;
(b) secure the crib to the horizontal surface in a manner that does not impede the test;
(c) apply a torque of 8 N.m (newton meters) for 10 seconds on one of the slats;
(d) note any damage, turning or disengaging of the slat;
(e) repeat (c) and (d) with all other slats;
(f) apply, for a period of 30 seconds, a vertical upward force of 500 N at the middle of the top rail on one of the sides of the crib which has slats;
(g) note any damage or disengagement of any of the slats from the top rail; and
(h) repeat (f) and (g) on the remaining sides which have slats.

12. Every product shall be so designed and constructed as to preclude injury from shearing or pinching to infants and children.
(i) Every exposed part of a product shall be smoothly finished to eliminate rough or sharp edges, sharp corners or sharp points and be free from splits, cracks or other defects.
(ii) every cut edge of the metal tubing of a product that is accessible to the occupant of the product shall be smoothly finished to eliminate rough or sharp edges, sharp corners or sharp points and be free from splits, cracks or other defects, or protected by a cap that will remain in place when subjected to a force of 90 N applied in any direction.
(iii) The threaded end of every bolt of a product that is accessible to an occupant of the product shall be protected by an acorn nut or other suitable device.

13. Every open hole or slot of any shape in rigid materials is accessible to an occupant of the product:
(i) shall be of a size and shape that, if it admits a rod 5.5 mm in diameter, it shall also admit a rod 10 mm in diameter; or
(ii) shall have a depth no greater than the minor dimension of the opening if the hole or slot has one of its minor dimensions between 5.5 mm and 10 mm.

OPERATION OF PREFERRED EMBODIMENTS

The above described crib of a preferred embodiment of this invention is believed to meet all the above standard regulations.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. a crib comprising:
(a) a generally rectangular, fixed-height back wall, said back wall including an upper horizontal face, a lower horizontal face, an inner face, an outer face and a pair of lateral faces, each said lateral face having an outwardly facing surface;
(b) a pair of generally rectangular end gables, each said end gable including an upper horizontal face, a lower horizontal face and a pair of lateral end faces, said end gable including an inwardly-facing surface and an outwardly-facing surface, each said end gable being hingedly connected to an associated lateral face of said fixed-height back wall;
(c) at least two grooves within said inwardly facing surface of each of said end gables, each of said grooves on one said gable being on the same horizontal plane as an associate groove in the other said gable;
(d) a mattress support having a specified rigidity selectively movably retained within selected grooves in the same horizontal plane in each of said end gables;
(e) a generally rectangular, slidable dropside front wall disposed between said inwardly-facing surfaces of said end gables, said slidable dropside front wall being vertically slidable between a vertical upper limit and a vertical lower limit, said slidable dropside front wall including an upper horizontal face, a lower horizontal face, and a pair of lateral faces, each said lateral face having an outwardly facing surface; and
(f) cooperating vertically-extending guide means between an inwardly facing surface of the lateral end faces of each end gable and the vicinal outwardly facing surface of the lateral faces of said slidable dropside front wall, to permit relative vertical movement of said slidable dropside front wall while preventing relative horizontal movement between said slidable dropside front wall and said end gables.

2. The crib of claim 1 wherein at least two grooves are also provided within said inner face of said fixed-height back wall, said grooves being in the same horizontal plane as associated grooves in said end gables, thereby to provide at least two horizontally-contiguous grooves.

3. The crib of claim 1 wherein said cooperating means (f) comprises a dovetail tongue on the inwardly-facing surface of the lateral end faces of each end gable, and a dovetail groove in the vicinal outwardly-facing surface of the lateral faces of said slidable dropside front wall.

4. The crib of claim 1 wherein said slidable dropside front wall is secured in its said vertical upper limit by means of a spring-loaded barrel bolt which can only be withdrawn following slight upward movement of said slidable dropside front wall and vertically-inward slidable movement of said bolt.

5. The crib of claim 1 wherein said vertical upper limit of said slidable dropside front wall is provided by a spring-loaded pin mounted in one said end gable, said pin being adapted to abut said upper horizontal face of said slidable dropside front wall.

6. The crib of claim 1 wherein said vertical lower limit of said slidable dropside front wall is provided by a spring-loaded pin mounted in one said end gable, said pin being adapted to abut said lower horizontal face of said slidable dropside front wall.

7. The crib of claim 1 wherein said generally-rectangular, fixed height back wall and said dropside front wall are each provided with a framework comprising a pair of spaced-apart vertical stiles, a pair of spaced-apart horizontal rails and a plurality of closely-spaced, vertically-oriented and spaced-apart slats disposed between said stiles and extending between said rails.

8. The crib of claim 1 wherein said generally-rectangular, fixed height back wall and said dropside front wall are each provided with a framework comprising a pair of spaced-apart vertical stiles, a pair of spaced-apart horizontal rails, a plurality of widely-spaced bars disposed between said stiles and extending between said rails, and a plurality of strong, transparent, synthetic plastic panels disposed between adjacent stiles and bars.

9. The crib of claim 1 wherein said mattress support comprises a sheet of plywood about ¾" thick.

10. The crib of claim 1 wherein said mattress support comprises a sheet of plywood about ¾" thick and further wherein said grooves are about ¾" in height and about ⅜" in depth.

11. The crib of claim 1 wherein the ratio of mattress support thickness/groove depth is 1/1 for flexible materials to 2/1 for rigid materials.

12. The crib of claim 1 wherein the grooves are formed only in the end gables and are of less than about ⅜" in depth but are covered by a plate having a longitudinally extending slot to provide a channel about ⅜" in depth, and wherein end faces of said mattress support are provided with a plurality of bolts, the heads of which are adapted to slide within said channel, the shanks of which are adapted to slide within said slot.

13. A crib comprising:

(a) a generally rectangular fixed-height back wall, said back wall including an upper horizontal face, a lower horizontal face, an inner face, an outer face and a pair of lateral faces, each said lateral face having an outwardly facing surface;

(b) a pair of generally rectangular end gables, each said end gable including an upper horizontal face, a lower horizontal face and a pair of lateral end faces, said end gable including an inwardly-facing surface and an outwardly facing surface, each said end gable being of the same height but being hingedly connected to an associated lateral face of said fixed-height back wall in such a manner that one said end gable is displaced vertically with respect to the other said end gable;

(c) a single groove within said inwardly facing surface of each of said end gables, said groove being spaced an unequal distance between said upper horizontal surface and said lower horizontal surface of said end gables;

(d) a mattress support having a specified rigidity selectively movably retained within said groove;

(e) a generally rectangular, slidable dropside front wall disposed between said inwardly-facing surfaces of said end gables, said slidable dropside front wall being vertically slidable between a vertical upper limit and a vertical lower limit, said slidable dropside front wall including an upper horizontal face, a lower horizontal face, and a pair of latreal faces, each said lateral face having an outwardly facing surface;

(f) cooperating vertically-extending guide means between an inwardly facing surface of the lateral end faces of each end gable and the vicinal outwardly facing surface of the lateral faces of said slidable dropside front wall, to permit relative vertical movement of said slidable dropside front wall while preventing relative horizontal movement between said slidable dropside front wall and said end gables; and (g) a pair of wheels or castors removably attached to the one said end gable which is displaced vertically higher with respect to the fixed-height back wall than the other said gable, whereby said crib is horizontally level.

14. The crib of claim 13 wherein a single groove is also provided within said inner face of said fixed-height back wall, said groove being in the same horizontal plane as said grooves in said end gables, thereby to provide one contiguous groove.

15. The crib of claim 13 wherein said cooperating means (f) comprises a dovetail tongue of the inwardly-facing surface of the lateral end faces of each end gable, and a dovetail groove on the vicinal outwardly-facing surface of the lateral faces of said slidable dropside front wall.

16. The crib of claim 13 wherein said slidable dropside front wall is secured in its said vertical upper limit by means of a spring-loaded barrel bolt which can only be withdrawn following slight upward movement of said slidable dropside front wall and vertically-inward slidable movement of said bolt.

17. The crib of claim 13 wherein said vertical limit of said slidable dropside front wall is provided by a spring-loaded pin mounted in one said end gable, said pin being adapted to abut said upper horizontal face of said slidable dropside front wall.

18. The crib of claim 13 wherein said vertical lower limit of said slidable dropside front wall is provided by a spring-loaded pin mounted in one said end gable, said pin being adapted to abut said lower horizontal face of said slidable dropside front wall.

19. The crib of claim 13 wherein said generally-rectangular, fixed height back wall and said dropside front wall are each provided with a framework comprising a pair of spaced-apart vertical stiles, a pair of spaced-apart horizontal rails and a plurality of closely-spaced, vertically-oriented and spaced-apart slats disposed between said stiles and extending between said rails.

20. The crib of claim 13 wherein said generally-rectangular, fixed height back wall and said dropside front wall are each provided with a framework comprising a pair of spaced-apart vertical stiles, a pair of spaced-apart horizontal rails, a plurality of widely-spaced bars disposed between said stiles and extending between said rails, and a plurality of strong, transparent, synthetic plastic panels disposed between adjacent stiles and bars.

21. The crib of claim 13 wherein said mattress support comprises a sheet of plywood about ¾" thick.

22. The crib of claim 13 wherein said mattress support comprises a sheet of plywood about ¾" thick and wherein said grooves are about ¾" in height and about ⅜" in depth.

23. The crib of claim 13 wherein the ratio of mattress support thickness/groove depth is about 1/1 for flexible materials to about 2/1 for rigid materials.

24. The crib of claim 13 wherein the grooves are formed only in the end gables and are of less than about ⅜" in depth but are covered by a plate having a longitudinal extending slot to provide a channel about ⅜" in depth, and wherein end faces of said mattress support are provided with a plurality of bolts, the heads of which are adapted to slide within said channel, the shanks of which are adapted to slide within said slot.

* * * * *